US011661729B2

(12) United States Patent
Sawaski et al.

(10) Patent No.: US 11,661,729 B2
(45) Date of Patent: May 30, 2023

(54) ELECTRONIC FAUCET INCLUDING CAPACITIVE SENSITIVITY CONTROL

(71) Applicant: Delta Faucet Company, Indianapolis, IN (US)

(72) Inventors: Joel D. Sawaski, Indianapolis, IN (US); Garry R. Marty, Fishers, IN (US)

(73) Assignee: Delta Faucet Company, Indianapolis, IN (US)

( * ) Notice: Subject to any disclaimer, the term of this patent is extended or adjusted under 35 U.S.C. 154(b) by 0 days.

(21) Appl. No.: 17/244,282

(22) Filed: Apr. 29, 2021

(65) Prior Publication Data

US 2022/0349162 A1 Nov. 3, 2022

(51) Int. Cl.
*E03C 1/05* (2006.01)
*E03C 1/04* (2006.01)

(52) U.S. Cl.
CPC ..... *E03C 1/057* (2013.01); *E03C 1/0404* (2013.01)

(58) Field of Classification Search
CPC ..... E03C 1/057; E03C 1/0404
See application file for complete search history.

(56) References Cited

U.S. PATENT DOCUMENTS 4,934,960 A 6/1990 Capp et al.
5,730,165 A * 3/1998 Philipp ..... H03K 17/955 324/677
6,853,337 B2 2/2005 Barabash
6,962,168 B2 11/2005 McDaniel et al.
7,458,520 B2 12/2008 Belz et al.
7,690,395 B2 4/2010 Jonte et al.
7,997,301 B2 8/2011 Marty et al.
8,376,313 B2 2/2013 Burke et al.
8,424,569 B2 4/2013 Marty et al.
8,469,056 B2 6/2013 Marty et al.
8,528,579 B2 9/2013 Jonte et al.
8,561,626 B2 10/2013 Sawaski et al.
8,613,419 B2 12/2013 Rodenbeck et al.
8,776,817 B2 7/2014 Sawaski et al.
8,844,564 B2 9/2014 Jonte et al.
8,939,429 B2 1/2015 Sawaski et al.
8,944,105 B2 2/2015 Rodenbeck et al.
8,973,612 B2 3/2015 Sawaski et al.
9,057,184 B2 6/2015 Meehan et al.
9,074,357 B2 7/2015 Meehan et al.
9,163,972 B2 10/2015 Veros et al.
9,175,458 B2 11/2015 Meehan et al.
9,187,884 B2 11/2015 Belz et al.
(Continued)

FOREIGN PATENT DOCUMENTS

CN 104089065 10/2014
WO 2007082301 7/2007

OTHER PUBLICATIONS

Delta Faucet Company, Quick Tips for your Delta Touch2O Technology Kitchen Faucet, Mar. 23, 2016.
(Continued)

*Primary Examiner* — Patrick C Williams
(74) *Attorney, Agent, or Firm* — Bose McKinney & Evans LLP

(57) ABSTRACT

An electronic faucet including a body, a capacitive sensor, a controller and a capacitive sensitivity adjustment device operably coupled to the controller to change the magnitude of an output signal of the capacitive sensor.

18 Claims, 9 Drawing Sheets

(56) References Cited

U.S. PATENT DOCUMENTS

| | | | | |
|---|---|---|---|---|
| 9,243,390 | B2 | 1/2016 | Rosko et al. | |
| 9,243,391 | B2 | 1/2016 | Jonte et al. | |
| 9,243,392 | B2 | 1/2016 | Marty et al. | |
| 9,315,976 | B2 | 4/2016 | Rodenbeck et al. | |
| 9,333,698 | B2 | 5/2016 | DeVries et al. | |
| 9,394,675 | B2 | 7/2016 | Sawaski et al. | |
| 9,603,493 | B2 | 3/2017 | Veros et al. | |
| 9,797,119 | B2 | 10/2017 | Belz et al. | |
| 9,976,291 | B2 | 5/2018 | Sawaski et al. | |
| 10,081,930 | B1 | 9/2018 | Zhuo et al. | |
| 10,227,759 | B2 | 3/2019 | Li et al. | |
| 2006/0289819 | A1* | 12/2006 | Parsons | E03C 1/057 251/129.04 |
| 2016/0215482 | A1* | 7/2016 | Fourman | E03C 1/0404 |
| 2016/0362877 | A1 | 12/2016 | Thomas et al. | |
| 2018/0119842 | A1* | 5/2018 | Morrish | H01F 7/1844 |
| 2020/0299941 | A1 | 9/2020 | Veros et al. | |

OTHER PUBLICATIONS

Aerada Capacitive Faucet, Aerada™ 1200 Series CS Faucet, retrieved on Nov. 10, 2020 from https://docplayer.net/74598409-Intallation-important-aerada-1200-series-cs-faucet-s-battery-operated-capacitive-sensing-faucet.html, 7 pages.

Delta 631TP Faucet, Delta 631TP3x0 Installation and Setup, retrieved on Nov. 20, 2020 from https://s1.img-b.com/faucet.com/mediabase/specifications/delta/1292342/delta-631tp320-installation-sheet.pdf, 18 pages.

Grohe Minta Touch Faucet, Grohe Minta Touch, retrieved on Nov. 10, 2020 from https://downloads.grohe.com/files/us/pdf/Minta_Touch_Installation.pdf, 19 pages.

Touch-activated Faucet, DIY Installing a Touch-Activated Kitchen Faucet, retrieved on Nov. 10, 2020 from https://extremehowto.com/touch-activated-kitchen-faucet, 8 pages.

Delta Faucet Company, TOUCH2O PULL-OUT KITCHEN & BAR/PREP FAUCET, 92834, Apr. 11, 2018, 20 pages.

* cited by examiner

ELECTRONIC FAUCET INCLUDING CAPACITIVE SENSITIVITY CONTROL

BACKGROUND AND SUMMARY OF THE DISCLOSURE

The present disclosure relates generally to an electronic faucet and, more particularly, to a capacitive sensing faucet including user defined sensitivity control.

Electronic faucets are known in the art for controlling fluid flow. Some electronic faucets include proximity sensors such as active infrared (IR) proximity detectors or capacitive proximity sensors to control operation of the faucet. Such proximity sensors are typically used to detect a user's hands positioned near the faucet and automatically start fluid flow through the faucet in response to detection of the user's hands. Other electronic faucets may use touch sensors to control the faucet. Such touch sensors may include capacitive touch sensors or other types of touch sensors located on a spout or on a handle of the faucet for controlling operation of the faucet. Electronic faucets may also include separate touch and proximity sensors.

In capacitive sensing faucets, the connection between the capacitive sensor and the faucet body may be installed inconsistently. For example, capacitive sensing faucets often include a connection clip coupling a mounting shank of the faucet to a controller. Such a connection clip may be excessively stiff, making assembly difficult for the installer. More particularly, the installer may bend the connection clip out of shape to make it easier to connect. This can have the effect of reducing the contact of the connection clip to the mounting shank, thereby resulting in inconsistent performance of the faucet.

Traditional capacitive sensing faucets may also have an unusually high capacitive output signal. This is typically found on larger faucets mounted on electrically non-conductive sink decks (e.g., thick composite sink decks vs. thin metal sink decks). Such a high capacitive output signal can significantly reduce the performance of the faucet.

As such, there is a need for a connection method that is easier to make, has improved contact with the mounting shank, and provides means for reducing the capacitive output signal for certain mounting applications.

According to an illustrative embodiment of the present disclosure, an electronic faucet includes a faucet body having a fluid passageway, an electrically operable valve coupled to the fluid passageway, and a controller operably coupled to the electrically operable valve for controlling fluid flow through the fluid passageway. A capacitive sensor is electrically coupled to the controller, wherein the controller is configured to monitor an output signal from the capacitive sensor in response to input from a user. The input includes at least when a portion of the faucet body is touched by a user or when a user's hands are located in a detection zone located near the portion of the faucet body. A capacitive sensitivity adjustment device is operably coupled to the controller to change magnitude of the output signal in response to input from the user.

According to another illustrative embodiment of the present disclosure, an electronic faucet includes a faucet body having a mounting shank and a fluid passageway, an electrically operable valve coupled to the fluid passageway, and a controller operably coupled to the electrically operable valve for controlling fluid flow through the fluid passageway. A capacitive sensor is electrically coupled to the controller, wherein the controller is configured to monitor an output signal from the capacitive sensor in response to input from a user. The input includes at least when a portion of the faucet body is touched by a user or when a user's hands are located in a detection area located near the portion of the faucet body. A capacitive sensitivity adjustment device is operably coupled to the controller to change magnitude of the output signal in response to the input from the user. The capacitive sensitivity adjustment device includes an electrode operably coupled to the mounting shank and the capacitive sensor via a control wire. The electrode includes a retainer, a primary contact supported by the retainer in an electrical contact with the mounting shank, and a secondary contact supported by the retainer in spaced relation to the primary contact such that a gap is defined between the first contact and the secondary contact, the secondary contact capacitively coupled to the primary contact.

According to a further illustrative embodiment of the present disclosure, a connector assembly includes a retainer, a primary contact including a primary connection tab and supported by the retainer, and a secondary contact including a secondary connection tab and supported by the retainer in radially spaced relation to the primary contact such that a gap is defined between the primary contact and the secondary contact, the secondary contact capacitively coupled to the primary contact. The retainer includes an upper support, a lower support spaced apart from the upper support, and a plurality of slots formed within the lower support to receive the primary connection tab of the primary contact and the secondary connection tab of the secondary contact.

Additional features and advantages of the present invention will become apparent of those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

Figure 1:
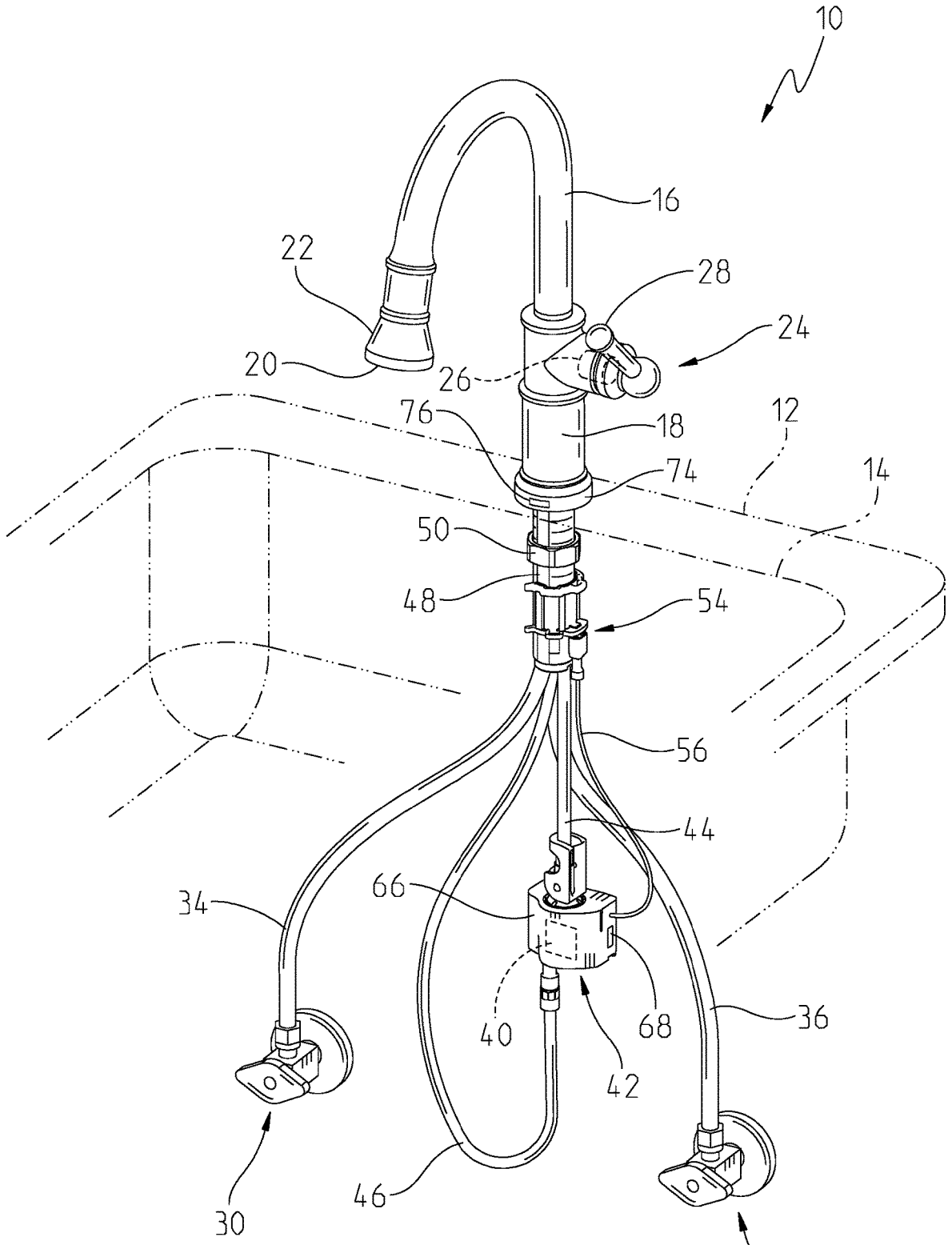
FIG. 1 is a perspective view of an electronic faucet mounted to a sink deck with a control box supported below the sink deck.

For the purposes of promoting an understanding of the principles of the present disclosure, reference will now be made to the embodiments illustrated in the drawings, which are described herein. The embodiments disclosed herein are not intended to be exhaustive or to limit the invention to the precise form disclosed. Rather, the embodiments are chosen and described so that others skilled in the art may utilize their teachings. Therefore, no limitation of the scope of the claimed invention is thereby intended. The present invention includes any alterations and further modifications of the illustrated devices and described methods and further applications of principles in the invention which would normally occur to one skilled in the art to which the invention relates.

Figure 2A:
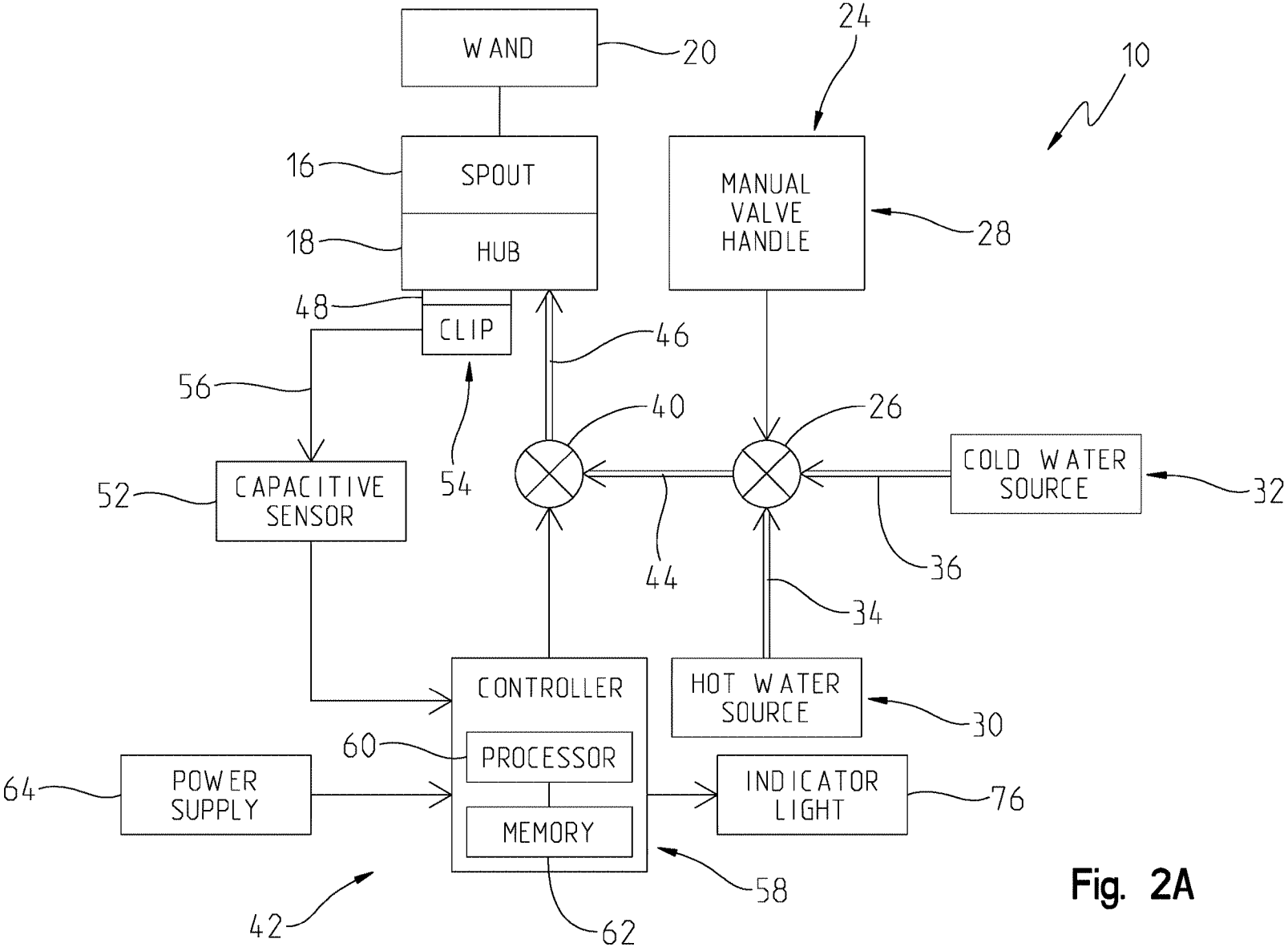
FIG. 2A is a block diagram of an illustrative electronic faucet according to FIG. 1.

Referring initially to FIGS. 1 and 2A, an illustrative faucet 10 is shown supported by a conventional support, such as a mounting or a sink deck 12 above a basin or sink 14. The illustrative electronic faucet 10 includes an upper faucet body having a delivery spout 16 supported by a hub 18 coupled to the sink deck 12. The delivery spout 16 supports a water outlet 20 for dispensing water into the sink basin 14. The water outlet 20 may be defined by a conventional aerator supported within a pullout wand or sprayhead 22 removably coupled to an outlet end of the delivery spout 16. The delivery spout 16 is illustratively formed of an electrically conductive material, such as a die-cast zinc or a chrome plated polymer.

A manual valve is 26 is illustratively supported by the delivery spout 16 and is fluidly coupled to a hot water source 30 and a cold water source 32. The hot water source 30 and the cold water source 32 may be defined by conventional water valve stops (FIG. 1). More particularly, a flexible hot water inlet tube 34 fluidly couples the hot water source 30 to the manual valve 26, and a flexible cold water inlet tube 36 fluidly couples the cold water source 32 to the manual valve 26. In an illustrative embodiment, an electrically operable valve 40 is fluidly coupled in series with, and downstream from, the manual valve 26. The electrically operable valve 40 is illustratively part of a control unit 42. A flexible connecting tube 44 illustratively fluidly couples the manual valve 26 to the electrically operable valve 40. A flexible outlet tube 46 may define a fluid passageway fluidly coupling the electrically operable valve 40 to the water outlet 20. The flexible outlet tube 46 may be slidably received within the hub 18 and the delivery spout 16 to permit removal of the sprayhead 22 from the outlet end of the delivery spout 16. The tubes 34, 36, 44 and 46 may be formed of a polymer, illustratively a cross-linked polyethylene (PEX).

A lower faucet body includes an externally threaded mounting shank 48 illustratively extending down from the faucet hub 18 and in electrical communication therewith. The mounting shank 48 is formed of an electrically conductive material, illustratively a metal, such as aluminum or brass. A mounting nut 50 threadably couples with the mounting shank 48 and is configured to secure the faucet 10 to the sink deck 12. Illustratively, a capacitive sensor 52 is electrically coupled to the hub 18 and the delivery spout 16 via the mounting shank 48. An electrode, illustratively a connector assembly 54, is in electrical contact with the mounting shank 48. Illustratively, a control wire 56 electrically couples the connector assembly 54 to a controller 58 forming part of the control unit 42.

Figure 2B:
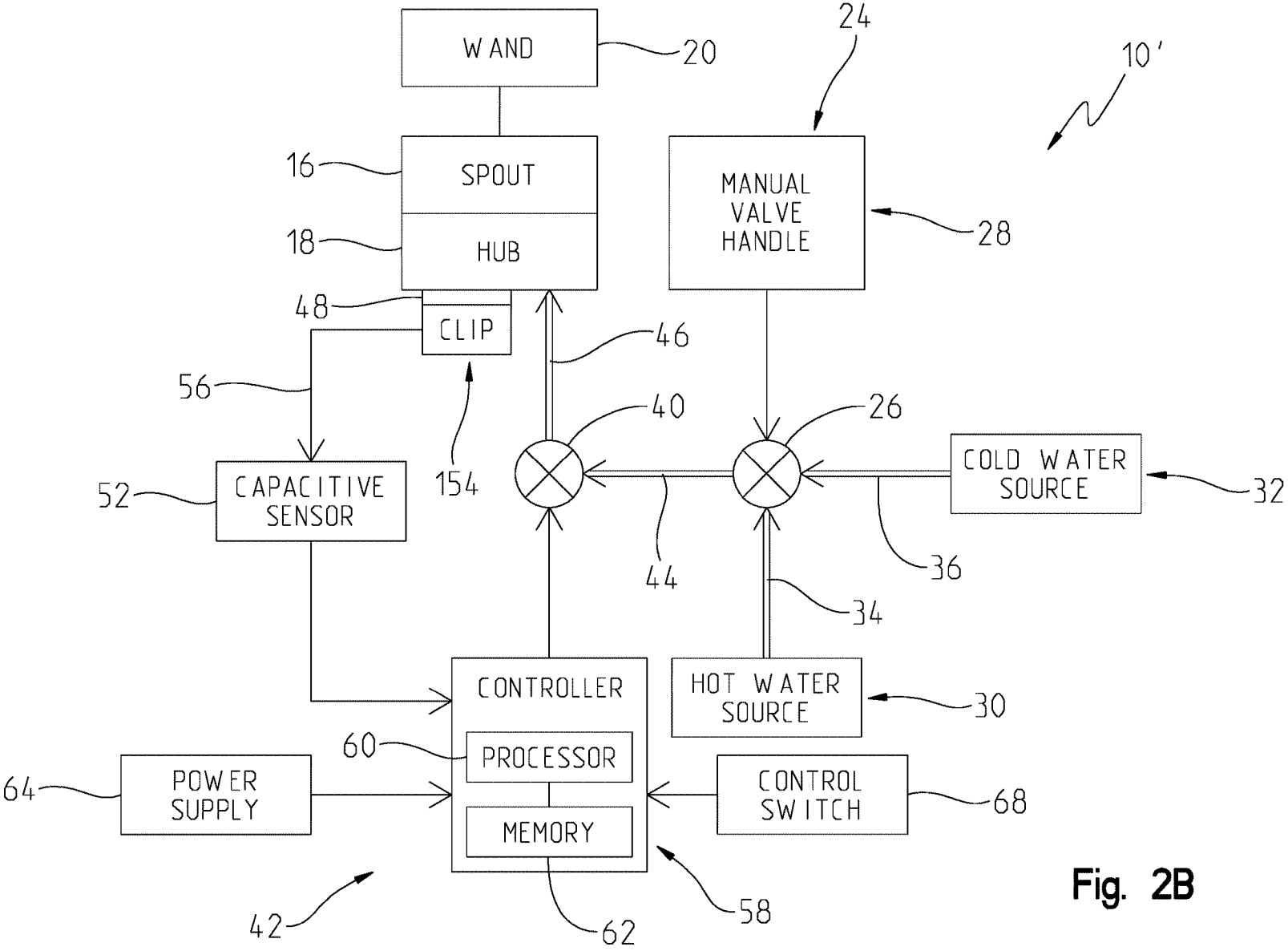
FIG. 2B is a block diagram of another illustrative electronic faucet according to FIG. 1.

The electrically operable valve 40 is in electrical communication with the controller 58. The controller 58 illustratively includes a processor 60 in communication with a memory 62 for processing output signals from the capacitive sensor 52. A power supply 64, such as a battery, is in electrical communication with the processor 60. The control unit 42 (including the electrically operable valve 40, the capacitive sensor 52, the controller 60, the memory 62, and the power supply 64) may be received within a control housing 66 (FIG. 1). A user interface, such as a control switch 68, is illustratively supported by the control housing 66 and is in electrical communication with the processor 60 (FIGS. 1 and 2B).

The controller 58 is configured to monitor an output signal from the capacitive sensor 52 in response to input from a user. Such an input may be defined by a user touching or being in proximity to the upper faucet body. For example, the capacitive sensor 52 generates an output signal when the delivery spout 16 or the hub 18 is touched by a user, and/or when a user's hands are located in a detection area located near the delivery spout 16 or the hub 18.

An insulator base 74 is illustratively positioned intermediate to the faucet hub 18 and the sink deck 12. The insulator base 74 is illustratively formed of an electrically insulating material, such as polymer, and may support an indicator light 76. The indicator light 76 is illustratively in electrical communication with the controller 58 and may provide, for example, an indication of faucet status (e.g., on/off, low battery, etc.) or a parameter water (e.g., color indicating temperature, intensity indicating flow rate, etc.) supplied to the outlet 20.

With reference to FIGS. 3-6, the connector assembly 54 defines an illustrative capacitive sensitivity adjustment device operably coupled to the controller 58 to adjust the magnitude of the output signal from the capacitive sensor 52. The connector assembly 54 illustratively includes a retainer 82, and a capacitive coupling 84 defined by a main or primary contact 86 and an auxiliary or secondary contact 88 separated from the primary contact 86 by an annular gap 90. The retainer 82 is illustratively formed of an electrically insulating material, such as a molded polymer. The contacts 86 and 88 are illustratively formed of an electrically conductive material, such as a stamped metal, illustratively copper.

With reference to FIGS. 3-5 and 7, the primary contact 86 illustratively includes a main body 92 and a downwardly extending primary connection tab 94 laterally offset from the main body 92. The secondary contact 88 illustratively includes a main body 96 and a downwardly extending secondary connection tab 98 laterally offset from the main body 96. The main bodies 92 and 96 of the primary and secondary contacts 86 and 88 are radially spaced apart from each other by the gap 90 to define the capacitive coupling 84. More particularly, the annular gap 90 is positioned intermediate an outwardly facing surface 99 of the primary contact 86 and an inwardly facing surface 101 of the secondary contact 88. An insulator coating 100 is illustratively supported by the main body 96 of the secondary contact 88. The insulator coating 100 is illustratively formed of an electrically insulating material, such as an epoxy.

Figure 5:
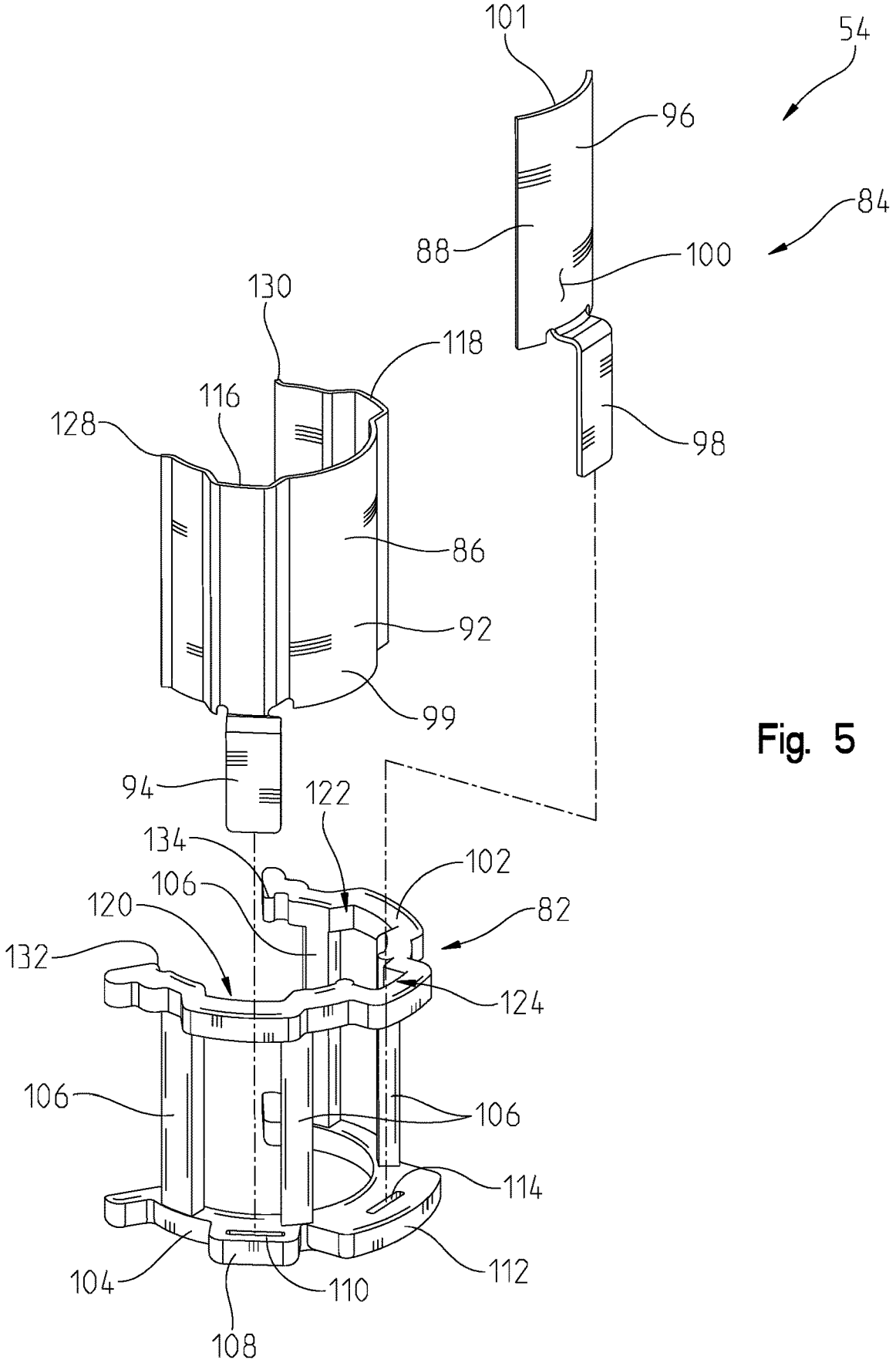
FIG. 5 is an exploded perspective view of the connector assembly of FIG. 3.
Figure 6:
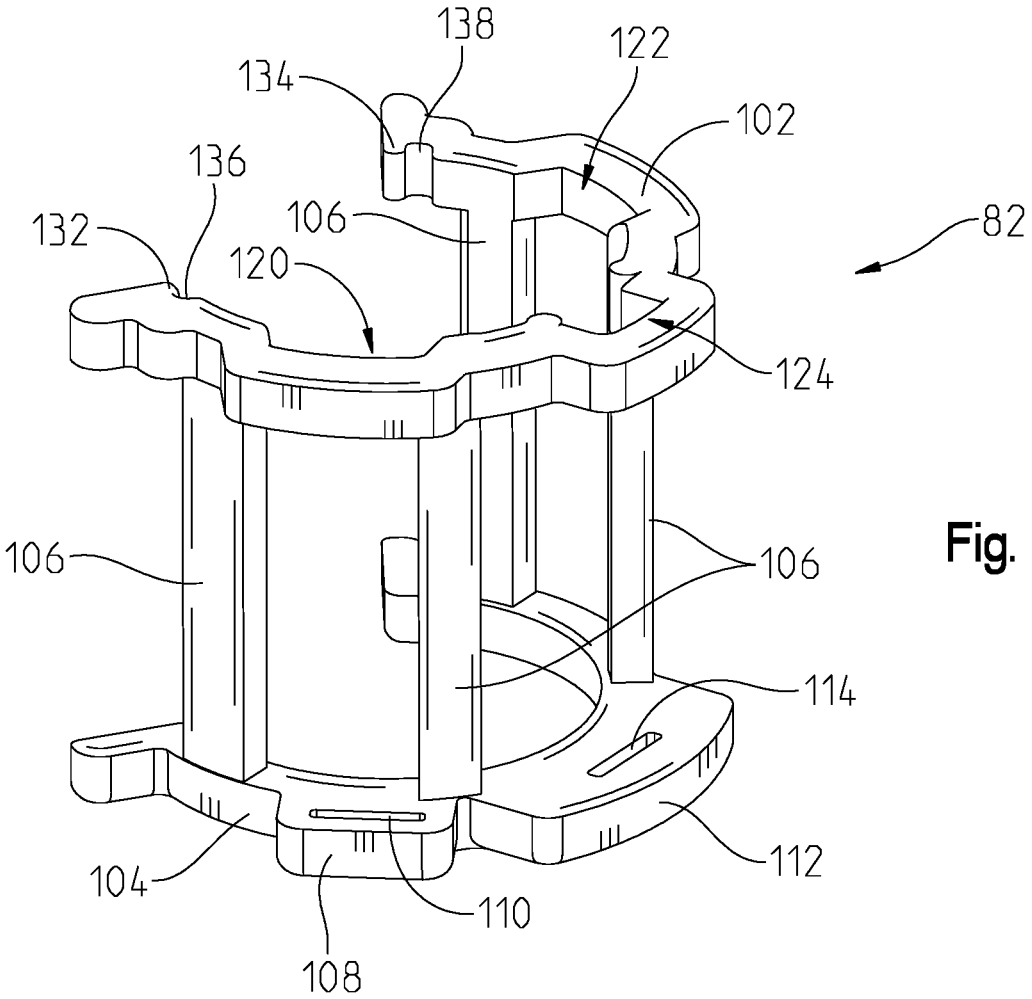
FIG. 6 is a perspective view of a retainer of the connector assembly of FIG. 3.
Figure 7:
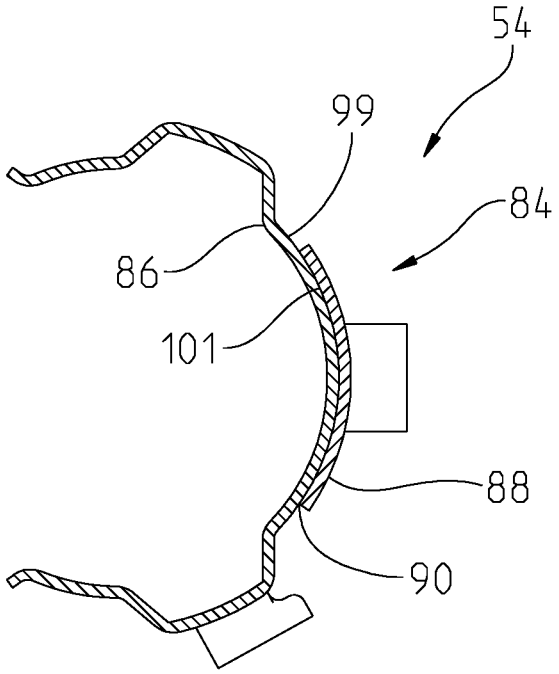
FIG. 7 is a cross-sectional view taken along line 7-7 of FIG. 3.

As shown in FIGS. 5 and 6, the illustrative retainer 82 includes an upper support 102 and a lower support 104 defining an opening 105 for receiving the mounting shank 48. In the illustrative embodiment, the retainer 82 is sized to couple to mounting shank 48 having an outer diameter of approximately 0.725 inches. A plurality of vertical arms 106 extend between the upper support 102 and the lower support 104. Radially outwardly extending protrusions or supports 108 and 112 include slots 110 and 114 for receiving the connection tabs 94 and 98 of the primary and secondary contacts 86 and 88, respectively.

More particularly, the connection tab 94 of the primary contact 86 is assembled through the slot 110 in the retainer 82 so that the connection tab 94 projects from below the protrusion 108 of the lower support 104. The connection tab 98 of the secondary contact 88 is assembled through the slot 114 in the retainer 82 so that the connection tab 98 projects beneath the protrusion 112 of the lower support 104 at a different level than connection tab 94 of the primary contact 86.

Figure 4:
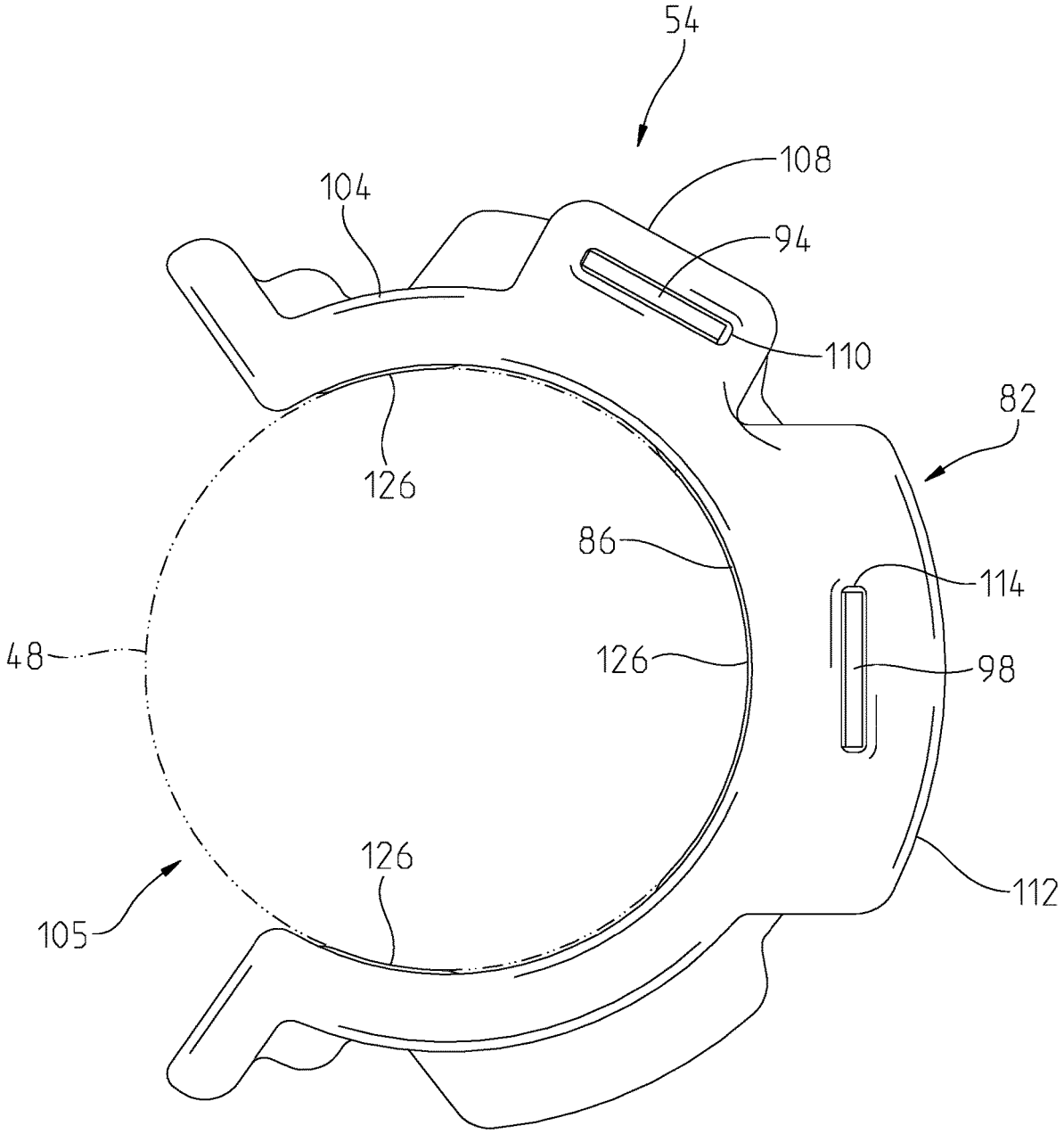
FIG. 4 is a bottom plan view of the illustrative connector assembly of FIG. 3, with the faucet mounting shank shown in phantom.

FIG. 4 is a bottom view of the connector assembly 54 with the mounting shank 48 inserted within the opening 105. The retainer 82 is sized to make sure the contact of the spout shank 48 rather than the retainer 82. The capacitive sensor 52 and the controller 58 is alternately electrically coupled to the primary contact tab 94 or the secondary contact tab 98 by control wire 56 (typically via a conventional receiver or socket connector (not shown)). More particularly, when connected to the control wire 56 the primary contact tab 94 defines a high capacitive output signal setting, while the secondary contact tab 98 defines a low capacitive output signal setting. This will allow for a good performing faucet 10 for a mass majority of the installations. A high capacitive sensitivity mode is defined by the controller 58 when the control wire 56 is electrically coupled to the primary connection tab 94. A low capacitive sensitivity mode is defined by the controller 58 when the control wire 56 is electrically coupled to the secondary connection tab 98. In an illustrative embodiment, the output signal from the capacitive sensor 52 in the low capacitive sensitivity mode is approximately 60% of the output signal from the capacitive sensor 52 in the high capacitive sensing mode in response to the same input (e.g., when a portion of the delivery spout 16 or hub 18 is touched by a user, or when a user's hands are located in a detection area located near the delivery spout 16 or hub 18).

As noted above, the secondary contact 88 is capacitively coupled to the primary contact 86 to define the capacitive coupling 84. The characteristics of the capacitive coupling 84 are dependent upon the geometry and arrangement of the connectors 86 and 88. More particularly, the strength of the capacitive coupling 84 depends upon the overlapping surface area of the opposing surfaces 99 and 101 of the primary and secondary contacts 86 and 88 and the width of the gap 90 (i.e., distance between the surfaces 99 and 101). In the illustrative embodiment, the overlapping surface area is approximately 0.43 square inches. Based on the geometry of the two connectors 86 and 88, the gap 90 between the opposing surfaces 99 and 101 of the two connectors 86 and 88 is illustratively 0.003 inches. The connection tab 98 of the secondary contact 88 is shielded by the protrusion 112, and the epoxy coating 100 of the main body 96 of the contact 88. The connection tab 98 is shielded by the coating 100 as it may need to be electrically connected to the electronics of the controller 58.

The insulator coating 100 of the secondary contact 88 illustratively provides two functions. The insulating coating 100 defines the proper gap 90 for the capacitive coupling 84, and protects the rest of the secondary contact 88 from water droplets. If the inwardly facing surface 101 of the secondary contact 88 was not coated, a droplet of water could potentially breech the primary contact 86 and the secondary contact 88 negating the capacitive coupling effect.

Figure 3:
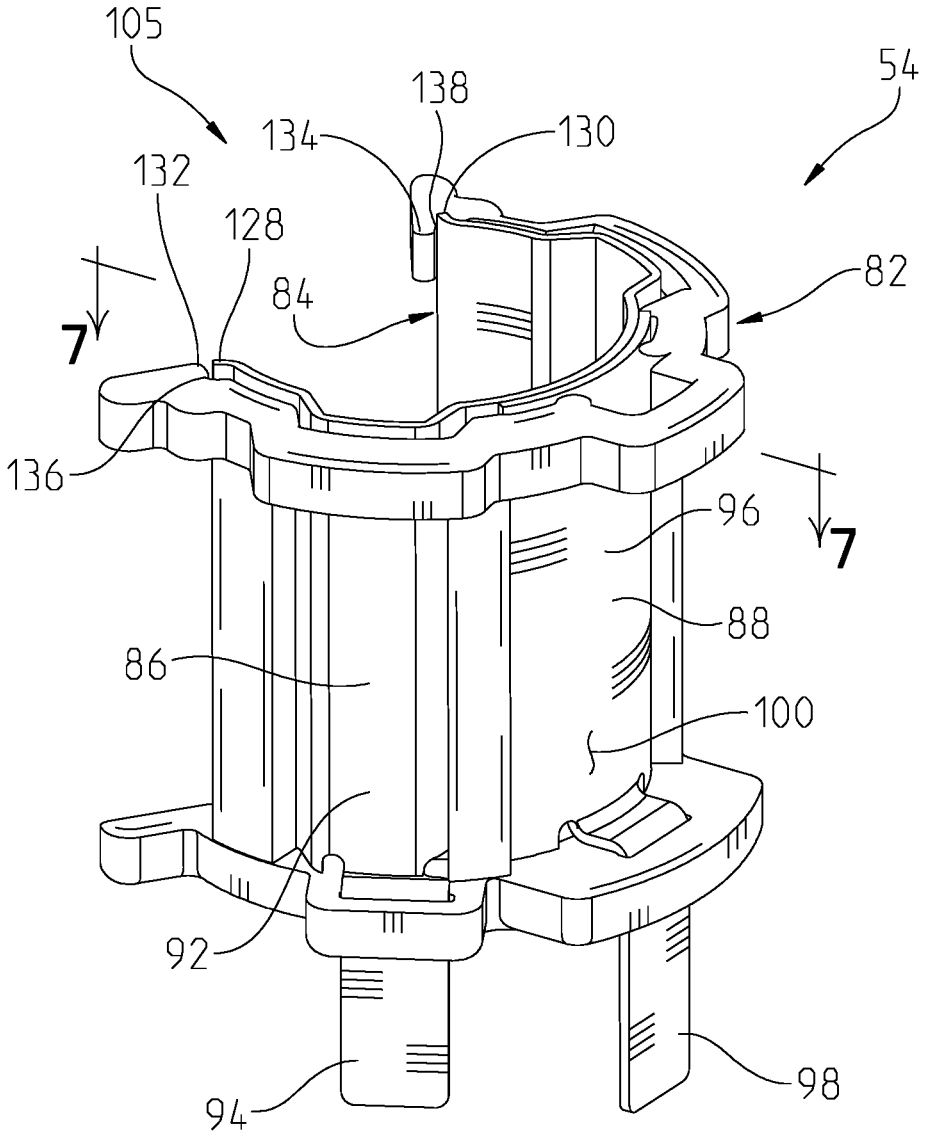
FIG. 3 is a perspective view of an illustrative connector assembly mounted to a mounting shank.

With reference to FIGS. 3-5, the primary and secondary contacts 86 and 88 are illustratively assembled to the retainer 82 from above. The primary contact 86 includes ears 116 and 118 received within recesses 120 and 122 in the retainer 82. The connection tab 94 of the primary contact 86 also passes through the mating slot 110 of the retainer 82. Opposing ends of the primary contact 86 illustratively includes projections or lips 128 and 130 secured by retainers 132 and 134, respectively. More particularly, the lips 128 and 130 are received within recesses 136 and 138, respectively, of the retainer 82.

The secondary contact 88 is received within a recess 124, while the connection tab 98 is received within the mating slot 114 of the retainer 82. A small barb (not shown) can be formed on the tabs 94 and 98 to act as retainers for the connector assembly 54. The retainer 82 holds the secondary contact 88 in proximity to the primary contact 86 making a capacitor (i.e., the capacitive coupling 84) that can be used to reduce a signal to the hub 18 and the delivery spout 16 in certain applications (e.g., mounting on thick composite sink decks).

One illustrative function of the connector assembly 54 is to easily connect to the spout shank 48 while maintaining good electrical contact with the spout shank 48. The connector assembly 54 will connect to the spout shank 48 by pressing the assembly 54 onto the shank 48 through the opening 105. The main contact 86 is illustratively heat treated to a spring temper which will act to clip onto the spout shank 48 and will contact the shank surfaces at contact areas 126 (FIG. 4). The retainer 82 acts to hold the assembly together, not as a clip itself.

Another function of the connector assembly 54 is to provide a reduced signal to installations where the signal strength is particularly high. The excessively high signal strength can negatively affect the performance of the faucet 10. As noted above, this is typically in larger faucets mounted on thick composite (electrically non-conductive) sink decks. Because the secondary contact 88 is capacitively coupled to the primary contact 86 and not in direct contact therewith, reduced capacitive output signals are transmitted by the capacitive sensor 52 as a result of user input (when the delivery spout 16 or the hub 18 is touched by a user, or when a user's hands are located in a detection area located near the delivery spout 16 or hub 18)., thereby improving the performance of faucet 10.

The surface area of the overlapping contact surfaces 99 and 101 of the primary and secondary contacts 86 and 88, and the gap 90 between them must be sized appropriately. For instance, the two surfaces 99 and 101 of the contacts 86 and 88 were the same size, and were held at 0.040 inches apart, a typical wall thickness for injection molding, a capacitive signal provided via the secondary contact 88 would typically not be sufficient to provide a functioning faucet 10. The size of the connector assembly 54, the surface area of the overlapping surfaces 99 and 101 in the gap 90 between the two contacts 86 and 88 have to be sized appropriately, changing one feature would require a change to the other.

With reference to FIGS. 1 and 2B, a further illustrative embodiment faucet 10' includes a capacitive sensitivity adjustment device defined by the user operable control switch 68 including at least two positions. A high capacitive sensitivity mode is defined by the controller 58 when the control switch 68 is in a first position, and a low capacitive sensitivity mode is defined by the controller 58 when the control switch 68 is in a second position.

Figure 2C:
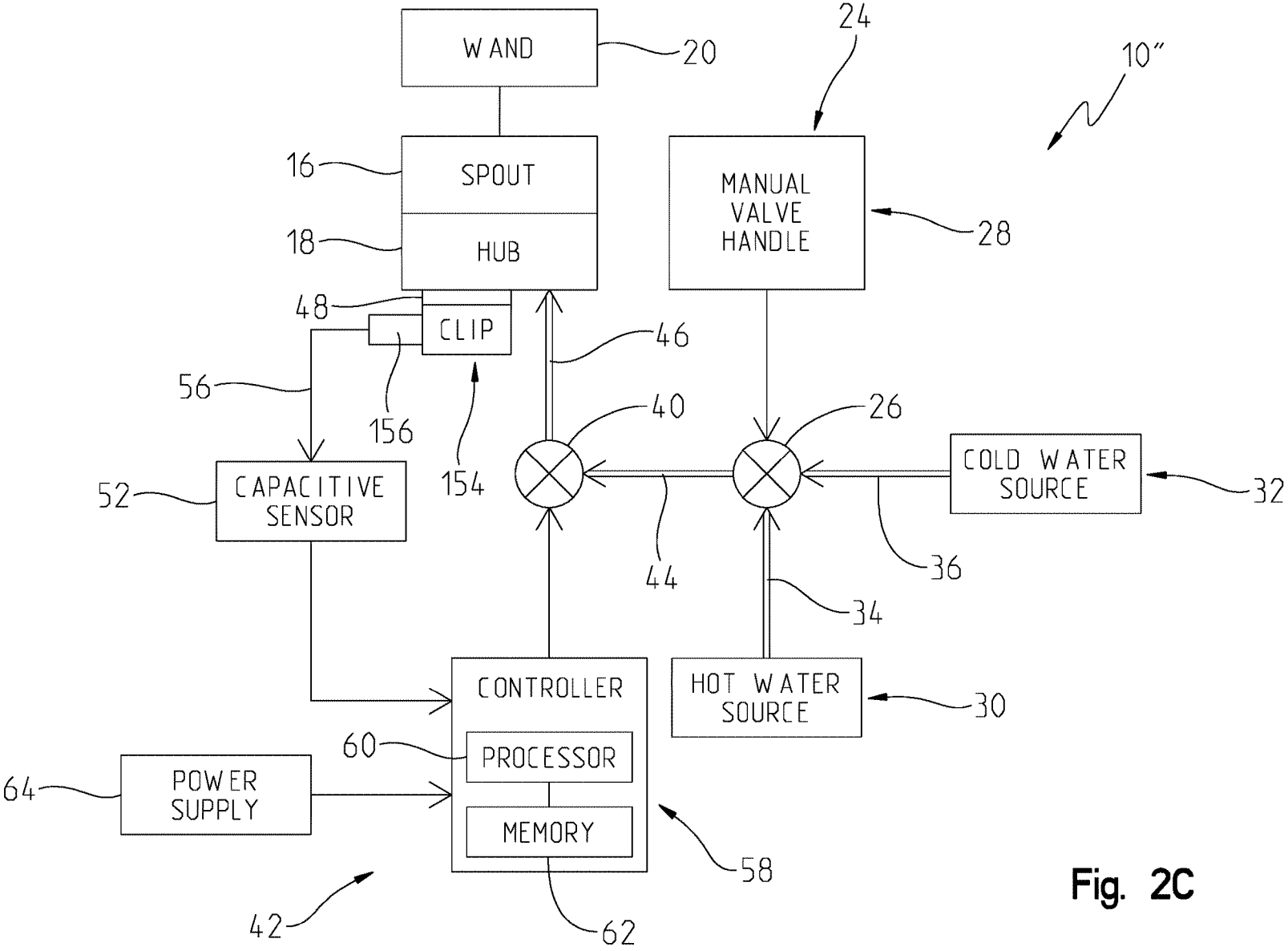
FIG. 2C is a block diagram of a further illustrative electronic faucet according to FIG. 1.
Figure 8:
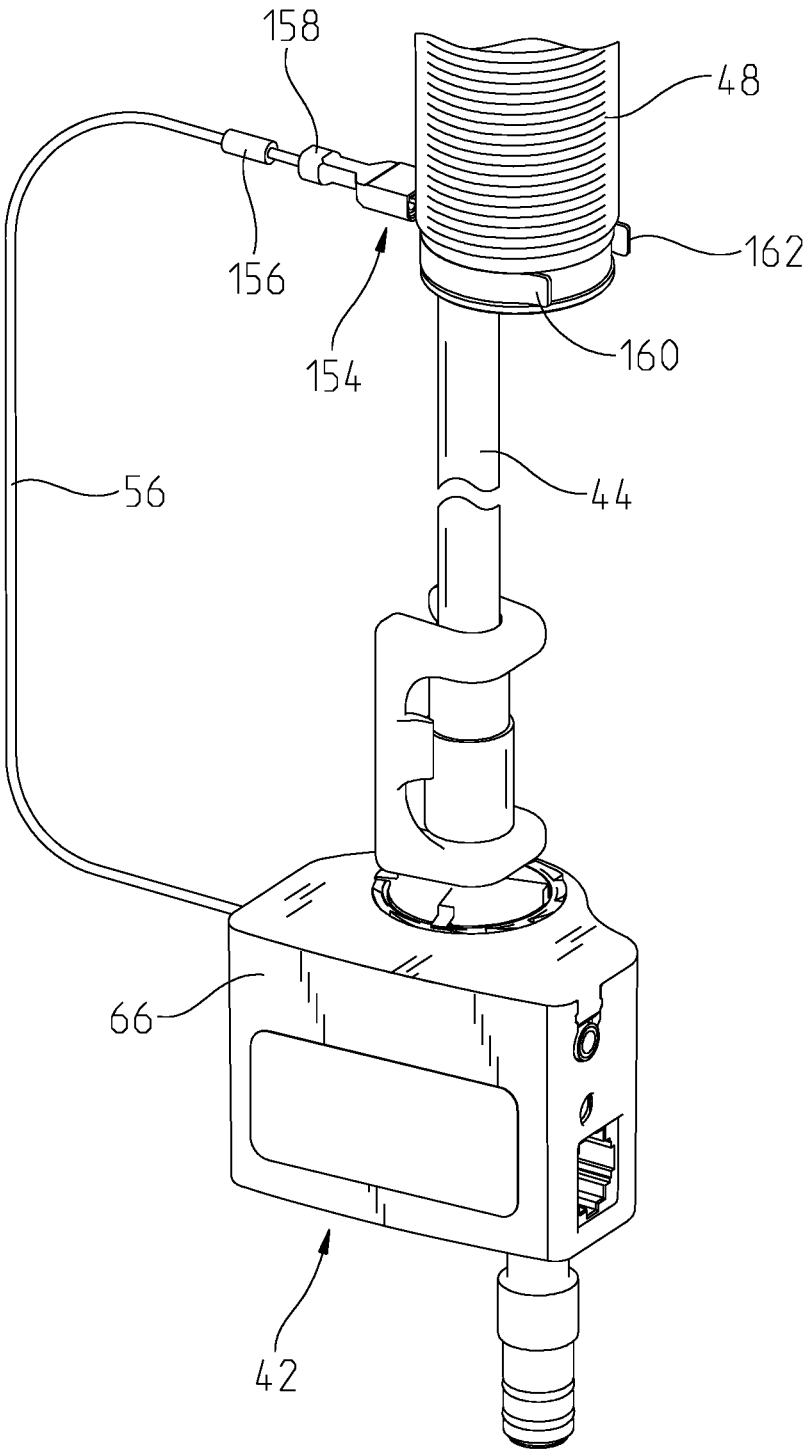
FIG. 8 is a perspective view of a further illustrative capacitive sensitivity adjustment device.

According to a further illustrative embodiment faucet 10" shown in FIGS. 2C and 8, a capacitive sensitivity adjustment device is defined by an electrode 154 electrically coupled in series with a resistor 156. The electrode 154 illustratively comprises a clip including a quick connect 158 to the resistor 156 at a first end, and opposing arms 160 and 162 at a second end. A high capacitive sensitivity mode is defined by the controller 58 when the resistor 156 is uncoupled from the electrode 154, and a low capacitive sensitivity mode is defined by the controller 58 when the resistor 156 is coupled in electrical series with the electrode 154.

Although the invention has been described in detail with reference to certain preferred embodiments, variations and modifications exist within the spirit and scope of the invention as described and defined in the following claims.

The invention claimed is:

1. An electronic faucet comprising:

a faucet body including a fluid passageway;

an electrically operable valve coupled to the fluid passageway;

a controller operably coupled to the electrically operable valve for controlling fluid flow through the fluid passageway;

a capacitive sensor electrically coupled to the controller;

wherein the controller is configured to monitor an output signal from the capacitive sensor in response to input from a user, the input including at least when a portion of the faucet body is touched by a user or when a user's hands are located in a detection area located near the portion of the faucet body;

a user operable capacitive sensitivity adjustment device operably coupled to the controller to change magnitude of the output signal in response to the input from the user;

wherein the capacitive sensitivity adjustment device includes a retainer, a primary contact supported by the retainer, and a secondary contact supported by the retainer in spaced relation to the primary contact such that a gap is defined between the primary contact and the secondary contact, the secondary contact capacitively coupled to the primary contact; and wherein the secondary contact is movable relative to the primary contact to adjust at least one of the gap or an overlapping surface area between the secondary contact and the primary contact.

2. The electronic faucet of claim 1, further comprising:

a control wire electrically coupled to the controller;

wherein the faucet body includes a mounting shank; and wherein the capacitive sensitivity adjustment device includes an electrode operably coupled to the mounting shank and the capacitive sensor via the control wire, the electrode including the retainer, the primary contact, and the secondary contact, the primary contact being in electrical contact with the mounting shank.

3. The electronic faucet of claim 2, wherein:

the primary contact includes a primary connection tab;

the secondary contact includes a secondary connection tab;

a high capacitive sensitivity mode is defined by the controller when the control wire is coupled to the primary connection tab; and a low capacitive sensitivity mode is defined by the controller when the control wire is coupled to the secondary connection tab.

4. The electronic faucet of claim 3, wherein the secondary contact includes an electrical insulating coating on an outer surface facing the primary contact.

5. An electronic faucet comprising:

a faucet body including a fluid passageway;

an electrically operable valve coupled to the fluid passageway;

a controller operably coupled to the electrically operable valve for controlling fluid flow through the fluid passageway;

a capacitive sensor electrically coupled to the controller;

wherein the controller is configured to monitor an output signal from the capacitive sensor in response to input from a user, the input including at least when a portion of the faucet body is touched by a user or when a user's hands are located in a detection area located near the portion of the faucet body;

a capacitive sensitivity adjustment device operably coupled to the controller; and wherein the capacitive sensitivity adjustment device includes a user operable switch including at least two positions, a high capacitive sensitivity mode defined by the controller when the switch is in a first position, and a low capacitive sensitivity mode defined by the controller when the switch is in a second position.

6. An electronic faucet comprising:

a faucet body including a mounting shank and fluid passageway;

an electrically operable valve coupled to the fluid passageway;

a controller operably coupled to the electrically operable valve for controlling fluid flow through the fluid passageway;

a capacitive sensor electrically coupled to the controller;

wherein the controller is configured to monitor an output signal from the capacitive sensor in response to input from a user, the input including at least when a portion of the faucet body is touched by a user or when a user's hands are located in a detection area located near the portion of the faucet body;

a control wire electrically coupled to the controller;

a capacitive sensitivity adjustment device operably coupled to the controller; and wherein the capacitive sensitivity adjustment device includes an electrode operably coupled to the faucet body and the capacitive sensor via the control wire, and a resistor removably coupled to the electrode, wherein a high capacitive sensitivity mode defined by the controller when the resistor is uncoupled from the electrode, and a low capacitive sensitivity mode defined by the controller when the resistor is coupled in electrical series with the electrode.

7. An electronic faucet comprising:

a faucet body including a mounting shank and a fluid passageway;

an electrically operable valve coupled to the fluid passageway;

a controller operably coupled to the electrically operable valve for controlling fluid flow through the fluid passageway;

a capacitive sensor electrically coupled to the controller;

wherein the controller is configured to monitor an output signal from the capacitive sensor in response to input from a user, the input including at least when a portion of the faucet body is touched by a user or when a user's hands are located in a detection area located near the portion of the faucet body;

a capacitive sensitivity adjustment device operably coupled to the controller to change magnitude of the output signal in response to the input from the user; and wherein the capacitive sensitivity adjustment device includes an electrode operably coupled to the mounting shank and the capacitive sensor via a control wire, the electrode including a retainer, a primary contact supported by the retainer and in electrical contact with the mounting shank, and a secondary contact supported by the retainer in spaced relation to the primary contact such that a gap is defined between the primary contact and the secondary contact, the secondary contact capacitively coupled to the primary contact.

8. The electronic faucet of claim 7, wherein:

the primary contact includes a primary connection tab;

the secondary contact includes a secondary connection tab;

a high capacitive sensitivity mode is defined by the controller when the control wire is coupled to the primary connection tab; and a low capacitive sensitivity mode is defined by the controller when the control wire is coupled to the secondary connection tab.

9. The electronic faucet of claim 8, wherein the secondary contact includes an electrical insulating coating on an outer surface facing the primary contact.

10. The electronic faucet of claim 8, wherein the retainer includes an upper support, a lower support spaced apart from the upper support, and a plurality of slots formed within the lower support to receive the primary connection tab of the primary contact and the secondary connection tab of the secondary contact.

11. The electronic faucet of claim 8, wherein an outer surface of the primary contact facing the secondary contact defines a first surface area, and an outer surface of the secondary contact facing the primary contact defines a second surface area, the first surface area being greater than the second surface area.

12. The electronic faucet of claim 11, wherein the secondary contact is positioned radially outwardly from the primary contact.

13. The electronic faucet of claim 7, wherein the secondary contact is movable relative to the primary contact to adjust at least one of the gap or an overlapping surface area between the secondary contact and the primary contact.

14. A connector assembly for an electronic faucet, the connector assembly comprising:

a retainer;

a primary contact including a primary connection tab and supported by the retainer;

a secondary contact including a secondary connection tab and supported by the retainer in radially spaced relation to the primary contact such that a gap is defined between the primary contact and the secondary contact, the secondary contact capacitively coupled to the primary contact; and wherein the retainer includes:

an upper support, a lower support spaced apart from the upper support, and a plurality of slots formed within the lower support to receive the primary connection tab of the primary contact and the secondary connection tab of the secondary contact; and wherein:

a high capacitive sensitivity mode is defined by the primary connection tab; and a low capacitive sensitivity mode is defined by the secondary connection tab.

15. The connector assembly of claim 14, wherein the secondary contact includes an electrical insulating coating on an outer surface facing the primary contact.

16. The connector assembly of claim 14, wherein an outer surface of the primary contact facing the secondary contact defines a first surface area, and an outer surface of the secondary contact facing the primary contact defines a second surface area, the first surface area being greater than the second surface area.

17. The connector assembly of claim 14, wherein the retainer is formed of a polymer, the primary contact is formed of a metal, and the secondary contact is formed of a metal.

18. A connector assembly for an electronic faucet, the connector assembly comprising:

a retainer;

a primary contact including a primary connection tab and supported by the retainer;

a secondary contact including a secondary connection tab and supported by the retainer in radially spaced relation to the primary contact such that a gap is defined between the primary contact and the secondary contact, the secondary contact capacitively coupled to the primary contact; and wherein the retainer includes:

an upper support, a lower support spaced apart from the upper support, and a plurality of slots formed within the lower support to receive the primary connection tab of the primary contact and the secondary connection tab of the secondary contact; and wherein the secondary contact is movable relative to the primary contact to adjust at least one of the gap or an overlapping surface area between the secondary contact and the primary contact.

* * * * *